US010675860B2

(12) United States Patent
Drees et al.

(10) Patent No.: US 10,675,860 B2
(45) Date of Patent: Jun. 9, 2020

(54) DEVICE FOR FIXING A CLAMPING FRAME TO AN OBJECT OR FIXING ITS ORIENTATION RELATIVE TO A MOTIF TO BE APPLIED TO THE OBJECT

(71) Applicant: Smake GmbH, Castrop-Rauxel (DE)

(72) Inventors: Thomas Drees, Waltrop (DE); Mark Busche, Herne (DE)

(73) Assignee: Smake GmbH, Castrop-Rauxel (DE)

( * ) Notice: Subject to any disclaimer, the term of this patent is extended or adjusted under 35 U.S.C. 154(b) by 0 days.

(21) Appl. No.: 16/333,260

(22) PCT Filed: Sep. 12, 2017

(86) PCT No.: PCT/EP2017/072829
§ 371 (c)(1),
(2) Date: Mar. 14, 2019

(87) PCT Pub. No.: WO2018/050620
PCT Pub. Date: Mar. 22, 2018

(65) Prior Publication Data

US 2019/0248129 A1 Aug. 15, 2019

(30) Foreign Application Priority Data

Sep. 14, 2016 (DE) ..... 10 2016 117 249

(51) Int. Cl.
*B41F 17/00* (2006.01)
*B41F 33/02* (2006.01)
*B41F 16/02* (2006.01)

(52) U.S. Cl.
CPC ..... *B41F 17/005* (2013.01); *B41F 16/02* (2013.01); *B41F 33/02* (2013.01)

(58) Field of Classification Search
CPC ..... B41F 16/02; B41F 17/00; B41F 17/005
(Continued)

(56) References Cited

U.S. PATENT DOCUMENTS 4,083,205 A * 4/1978 Clarke ..... B41F 16/02 100/233
2009/0056569 A1* 3/2009 Ando ..... B41F 17/005 101/41

(Continued)

OTHER PUBLICATIONS

Int'l Search Report dated Nov. 7, 2017 in Int'l Application No. PCT/EP2017/072829.

(Continued)

*Primary Examiner* — William C. Dowling
(74) *Attorney, Agent, or Firm* — Panitch Schwarze Belisario & Nadel LLP

(57) ABSTRACT

A device for positioning and fixing a clamping frame onto an object to be embroidered or printed, or for positioning the object to be embroidered or printed and arranged on a holder relative to the embroidering or printing motif. The device may include at least one projection means, e.g., a data projector, projector or augmented reality glasses, which projects onto the object at least one projection object stored in a data processing device, or else displays this in the augmented reality glasses. The data processing device may also include a memory in which is stored or will be stored after positioning has taken place: the type, size and/or shape of the object to be embroidered or printed, the motif to be embroidered or printed, and the position at which the motif is to be embroidered or printed on the object.

17 Claims, 7 Drawing Sheets

Figure 1:
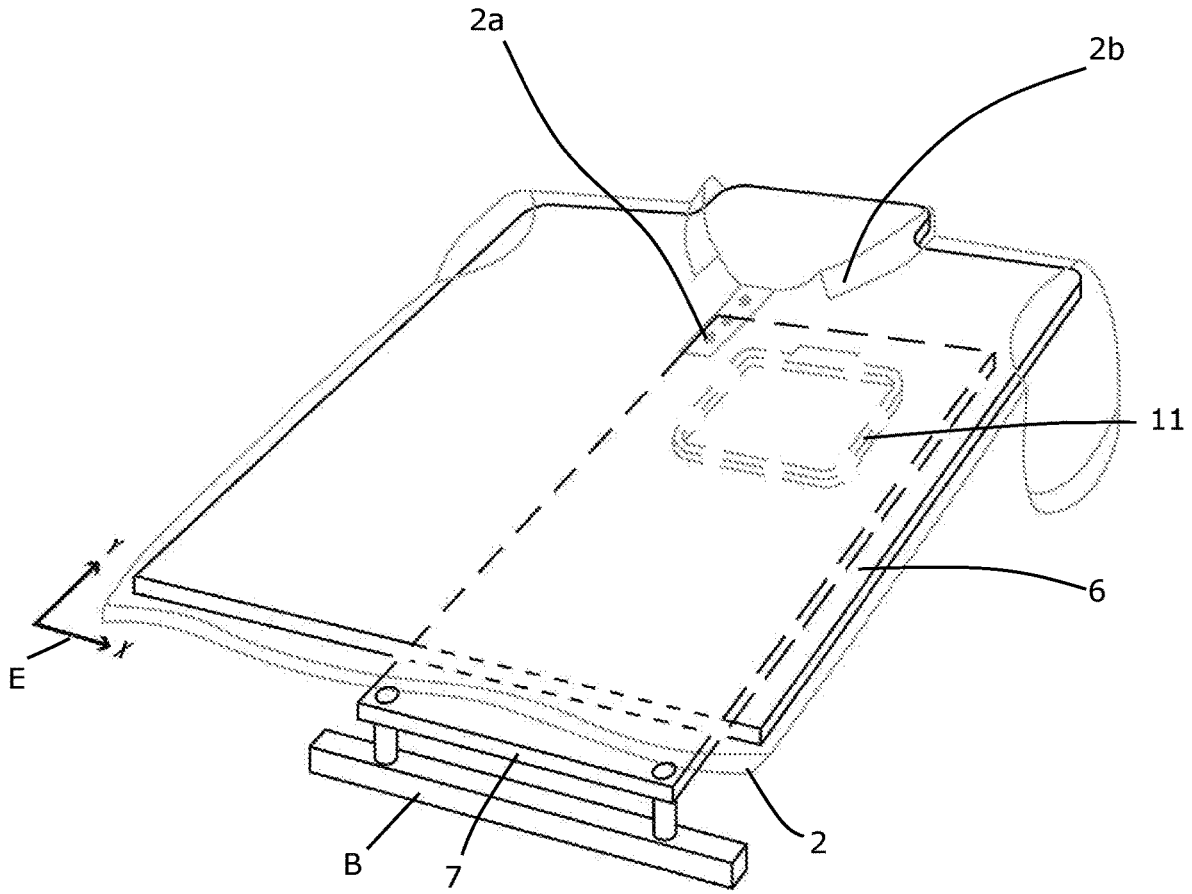

(58) Field of Classification Search
USPC ..... 353/10; 101/34, 474
See application file for complete search history.

(56) References Cited

U.S. PATENT DOCUMENTS

| | | | | |
|---|---|---|---|---|
| 2018/0147858 | A1* | 5/2018 | Kunioka | B41J 3/4078 |
| 2019/0168500 | A1* | 6/2019 | Martinez | B41J 11/02 |

OTHER PUBLICATIONS

Sewingmachinedotcom: "Hoopmater Demonstration", Tetrieved from the Internet: https://www.youtube.com/watch?v=uMGtBIIMjvU, Dec. 16, 2008.

* cited by examiner

DEVICE FOR FIXING A CLAMPING FRAME TO AN OBJECT OR FIXING ITS ORIENTATION RELATIVE TO A MOTIF TO BE APPLIED TO THE OBJECT

This application is a U.S. national-stage application, under 35 U.S.C. § 371, of PCT International Patent Application No. PCT/EP2017/072829, filed on Sep. 12, 2017, which claims priority from Application No. 10 2016 117 249.9, filed on Sep. 14, 2016 in Germany. The entire contents of these applications are incorporated herein by reference in their entirety.

The present invention relates to a device for positioning and fixing a clamping frame on an object to be embroidered or printed, in particular a textile, a shoe or an item of headwear, or for positioning the object, which is to be embroidered or printed and arranged on a holder, relative to the embroidering or printing motif.

When embroidering or printing on objects, in particular textiles such as T-shirts, jumpers, trousers, jackets, etc. or shoes and caps, it is important that the object is correctly aligned with the printing or embroidery machine, or else that it is known to the printing or embroidery machine in which position the object is located relative to the machine, whereupon the machine can calculate the offset data to start the printing or embroidery process, so that the embroidery motif or print motif can be applied to the correct place on the object.

If the object is to be printed, the object must be aligned relative to the printer. This is usually done by stretching the object onto a clamping table, wherein the object has to be clamped or fixed onto the clamping table in such a way that the print is applied in the correct place. The company brother® offers the system AccuLine®, in which the clamped object is photographed or filmed by means of a camera and the relevant image of the clamped object is displayed on a monitor. The operator can then use the monitor to move, rotate and scale the motif to be printed relative to the photographed object, wherein after positioning and scaling, the offset data for printing is calculated and taken into account during the printing.

In the embroidery field, from the company Hoop Master® a clamping frame positioning system is known which has a pegboard on which a clamping frame holder for a lower clamping frame part and an upper clamping frame part can be plugged in at different positions, wherein the pegboard is designed as a clamping frame for the object to be embroidered in the form of a shirt, T-shirt or pullover. The pegboard comprises for this purpose numbered holes, which are arranged in a grid, into which the clamping frame holder can be plugged. In this case, it is specified to the operator in which holes the clamping frame holder must be positioned or inserted on the pegboard. The lower part of the clamping frame is then inserted into the lower clamping frame holder and the object is pulled over the clamping frame or the pegboard and the lower clamping frame holder. The outer contour of the pegboard, which is adapted to the object, positions the object relative to the clamping frame. Subsequently, the upper clamping frame part inserted into the upper clamping frame holder part is moved to the lower clamping frame holder and magnetically fixed onto it, wherein the object is clamped between the two clamping frame parts. The object is then inserted by means of the clamping frame into the pantograph of an embroidery machine and then embroidered. However, due to the grid pattern of the holes and the elasticity of the object to be embroidered, the clamping frame can only be relatively imprecisely fixed to the object in this system, which does not ensure that the motif is embroidered at the point that was desired or predetermined.

The object of the present invention is to provide a device with which the alignment is effected quickly, easily, accurately and reliably.

The object according to the invention is achieved in that the device has at least one projection means, in particular a data projector, projector or augmented reality glasses (VR headset), which projects onto the object at least one projection object stored in a data processing device (DV), or else the device shows the projection object to the operator in the glasses by means of the augmented reality glasses (VR headset), wherein the data processing device (DV) comprises a memory in which is stored or will be stored after positioning has take place: the type, size and/or shape of the object to be embroidered or printed, the motif to be embroidered or printed, and the position at which the motif is to be embroidered or printed on the object.

By projecting projection objects realistically onto the object by means of a data projector or a projector, the operator is provided with a visual display, indicating how the object must be aligned or positioned relative to the device or the holder or at which point the motif is to be arranged. Instead of a data projector or a projector, it is of course also possible that the at least one projection object is displayed in the VR headset, wherein the VR headset calculates the position to be displayed on the basis of the viewing direction and the position of the device in the field of view.

The projection object can be one or more points, lines, a grid, the contour of the object to be embroidered or printed, in particular in the form of a button placket, the collar, the seams or pockets of the object, etc., a clamping frame window or the motif to be embroidered or printed itself. If projection objects have to be displayed, they can be projected one after the other or simultaneously or selectively. In the latter case, the operator can select which projection objects to display.

In a first possible embodiment of the invention, the device has a base on which a first clamping frame holder for receiving a first clamping frame part is fixed or can be fixed. The device furthermore comprises an object holder, which serves in particular for holding and/or clamping the object, wherein the object holder is adjustably mounted relative to the base, in particular on the base. In this case, the object holder is advantageously adjustable relative to the base only in one plane parallel to the plane spanned by the first clamping frame part and independently in both directions, so that the object holder can be arbitrarily positioned relative to the base within the limits defined by the mechanism. Preferably, the object holder can be guided by linear guides, which are arranged in particular perpendicular to each other, wherein the one guide is mounted longitudinally displaceably in the other. In this embodiment, a second clamping frame holder can be arranged on the base, wherein the second clamping frame holder serves for receiving a second clamping frame part, in particular the upper clamping frame part. The second clamping frame holder can be made at least partially of a flexible material or comprise a hinge, so that the second clamping frame part can be moved in a guided manner, in particular pivoted, to the first clamping frame part.

The device according to the first embodiment can also be further developed in that the device has a drive system for adjusting the object holder in the xy-plane. If the device is then provided with a camera, the position of the object on the object holder can be determined on the basis of its contours, in particular button placket(s), collar, sleeves or seam(s), then the object holder can be adjusted relative to the base using the drive so that the object is located in the correct position of the clamping frame part or parts located on the clamping frame holder and the clamping frame is then manually or automatically affixed to the object.

A second possible embodiment of the invention serves to position the object that is to be embroidered or printed and arranged on a holder relative to the motif to be embroidered or printed. For this purpose, the device has a clamping frame which is affixed to the object to be embroidered or printed. Subsequently, by means of the projection means, in particular a data projector, projector or augmented reality glasses (VR headset) at least the motif to be printed or its contours are projected onto the object or the same is displayed in the augmented reality glasses (VR headset), wherein the operator can move the motif, which is projected or displayed in the VR headset, relative to the object or clamping frame and can position it at the point where the motif should be printed or embroidered. The device remembers the offset data generated by the virtual shift and takes this into account in the subsequent printing or embroidering. In addition to the motif or its contours, contours or features of the object can still be projected onto the object itself. These contours are shown at the distance to the motif previously determined in the graphic design of the object. Thus, it is possible to take into account the displacement of the motif and the contours or features of the object that are shown, so that the final result is that the contours or features of the object are congruent with the contours or features of the real object.

The holder may also be a printing plate of a printer, onto which the object to be printed is affixed or clamped. The holder can either stand still during printing or is moved only in one direction.

In both previously described possible embodiments, the data processing device stores the data required in a memory, wherein in particular the type, size and/or shape of the object to be embroidered or printed, the motif to be embroidered or printed and the position at which the motif is to be embroidered or printed is stored, or will be stored after positioning.

When using a camera, the device can advantageously determine, on the basis of the recorded images, whether the clamping frame is affixed or will be affixed to the correct part of the object, and can generate a corresponding confirmation or error signal, which is visually displayed and/or is audible. This can advantageously save material, time and costs which would be incurred by incorrect printing or embroidery.

A method is also claimed, in which a clamping frame holder is affixed using the device as described above, whereby in a first method step the first clamping frame member is inserted into or secured onto the first clamping frame holder on the base, and in a subsequent method step the object is pulled over the object holder and over the first clamping frame holder, and that in a further method step a projection object is projected onto the object to be embroidered by means of the projection means, and that then the object holder is adjusted in the plane (x, y), manually or by means of the drive device, so that the object is in the correct position relative to the first and second clamping frame holder, and that in another method step the clamping frame holder is fastened to the object, in which the two clamping frame parts are brought together, in particular magnetically.

This method can be supplemented to the effect that after the positioning of the object holder relative to the clamping frame holders or parts, the motif to be embroidered or printed or its contours are projected onto the object and the projection is electronically shifted by the operator and/or is rotated relative to the object, wherein the control unit (DV) stores the relative shift and/or rotation of the motif for the subsequent embroidery or printing process and takes this into account during the embroidery or printing process. This makes it possible to make a virtual shift and/or rotation of the motif relative to the clamping frame after affixing the clamping frame, which is taken into account in the subsequent printing or embroidery process.

Likewise, a method is claimed for relatively positioning a motif, which is to be embroidered or printed on an object, using a device as described above, in which the object is first affixed to a holder, in particular clamped onto the latter, and then the at least one motif, which is to be embroidered or printed, or its contours, is projected by means of the projection means onto the object and the projection is controlled electronically by the operator, and is shifted and/or rotated relative to the object or to the holder, wherein the control unit stores the relative shift and/or rotation of the motif for the subsequent embroidery or printing process and takes this into account during the embroidery or printing process.

Various possible embodiments of the device according to the invention will be explained in more detail below with reference to the drawings.

Figure 2:
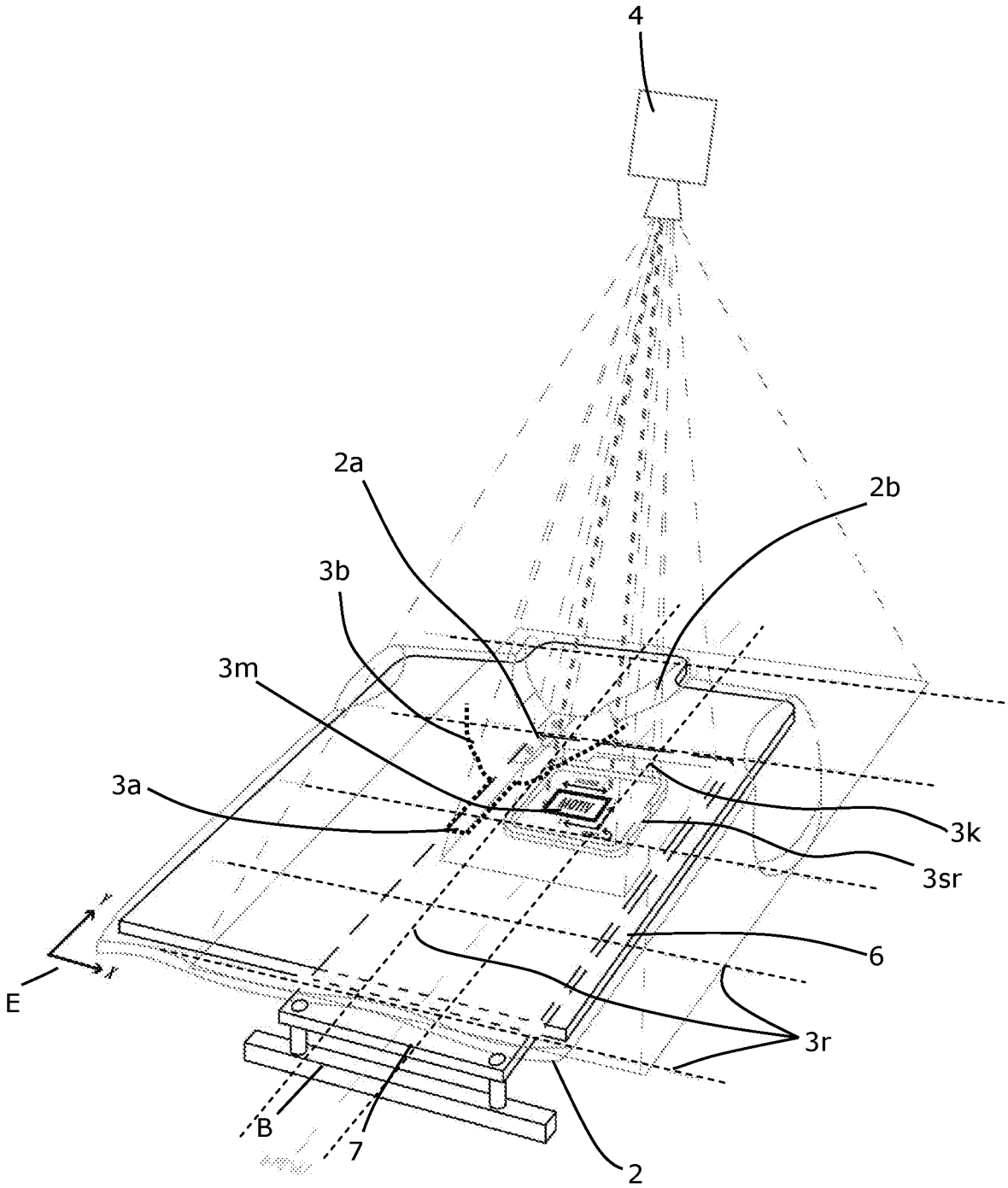
Figure 3:
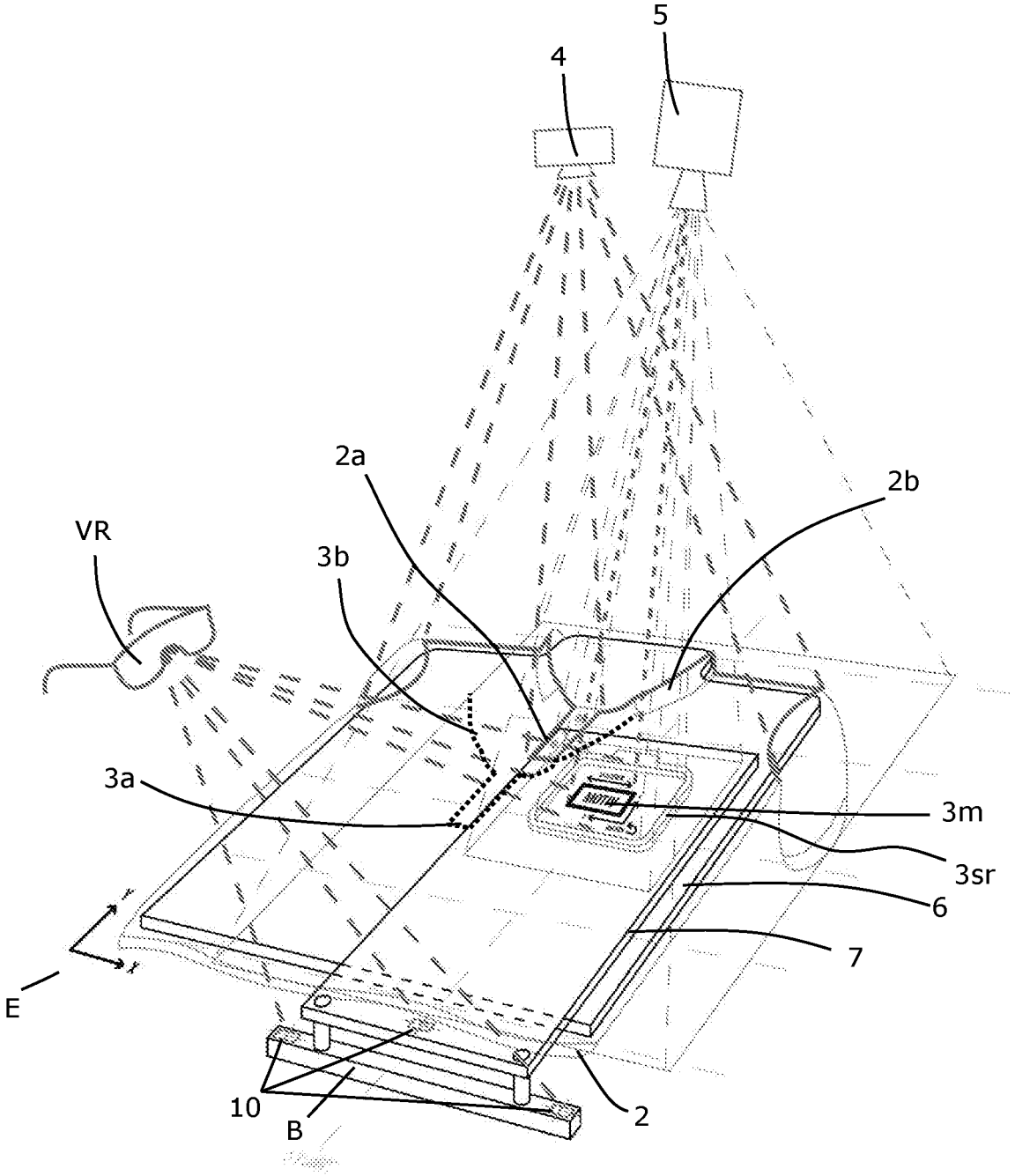
Figure 4:
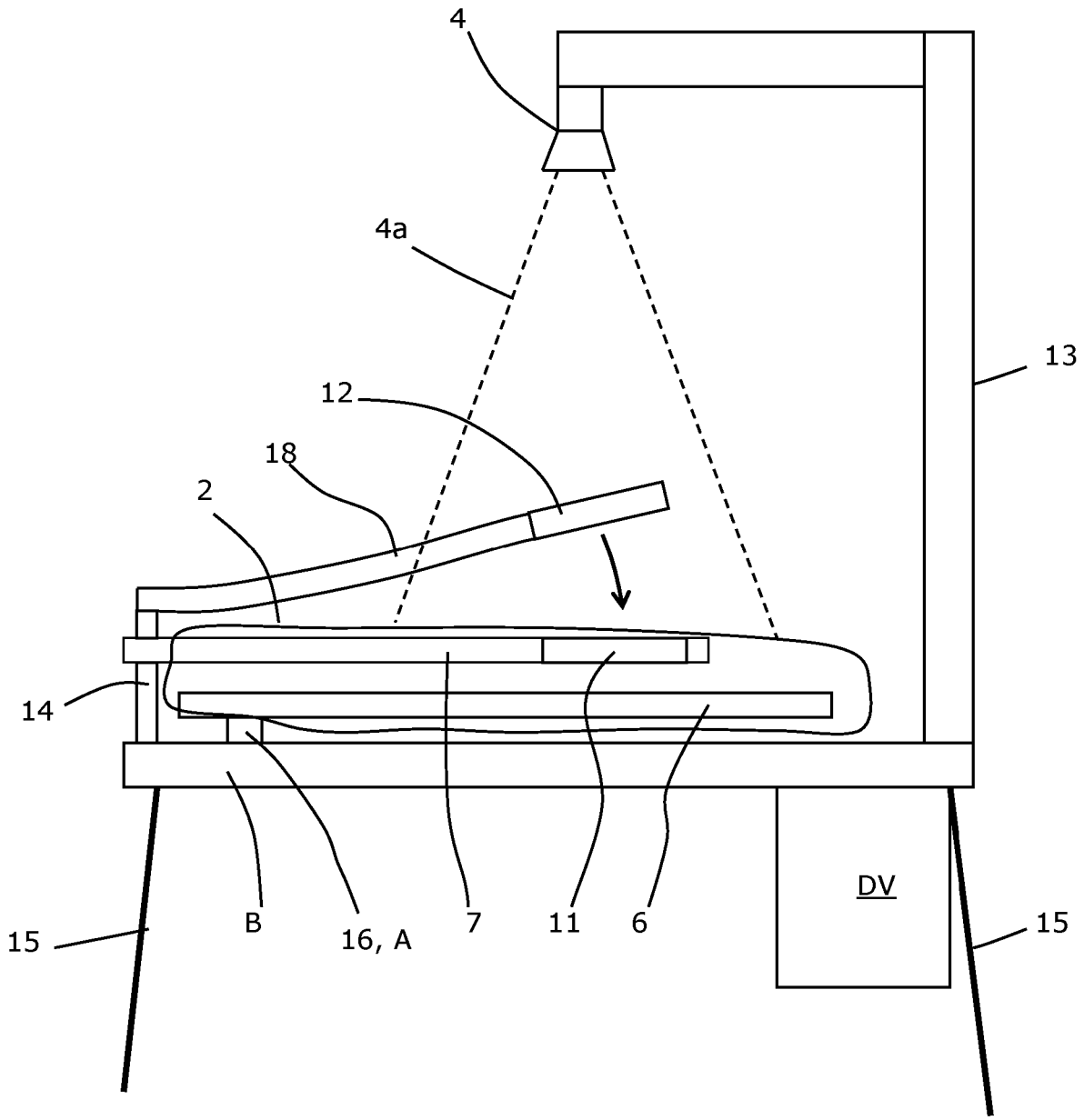
Figure 5:
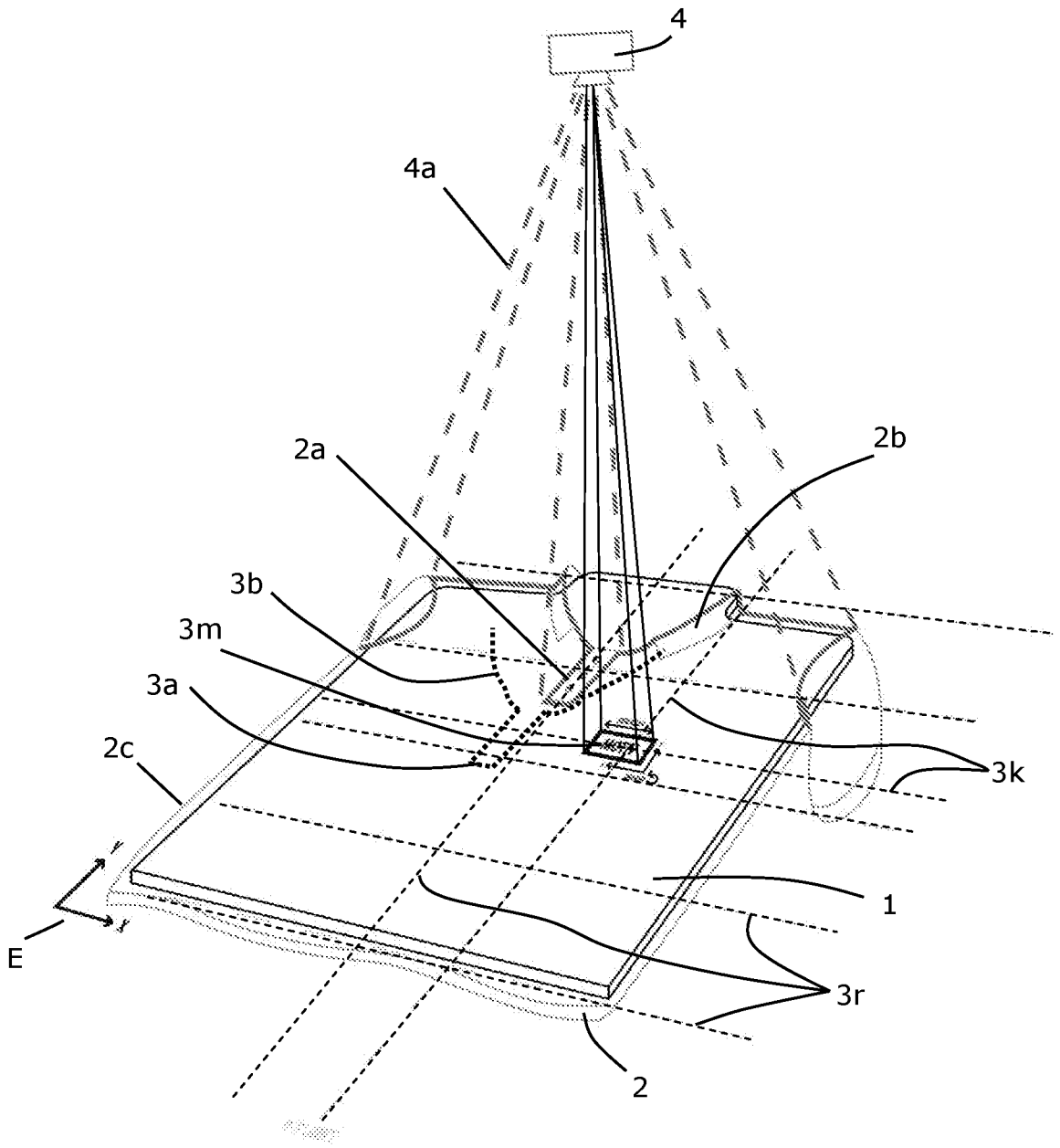
Figure 6:
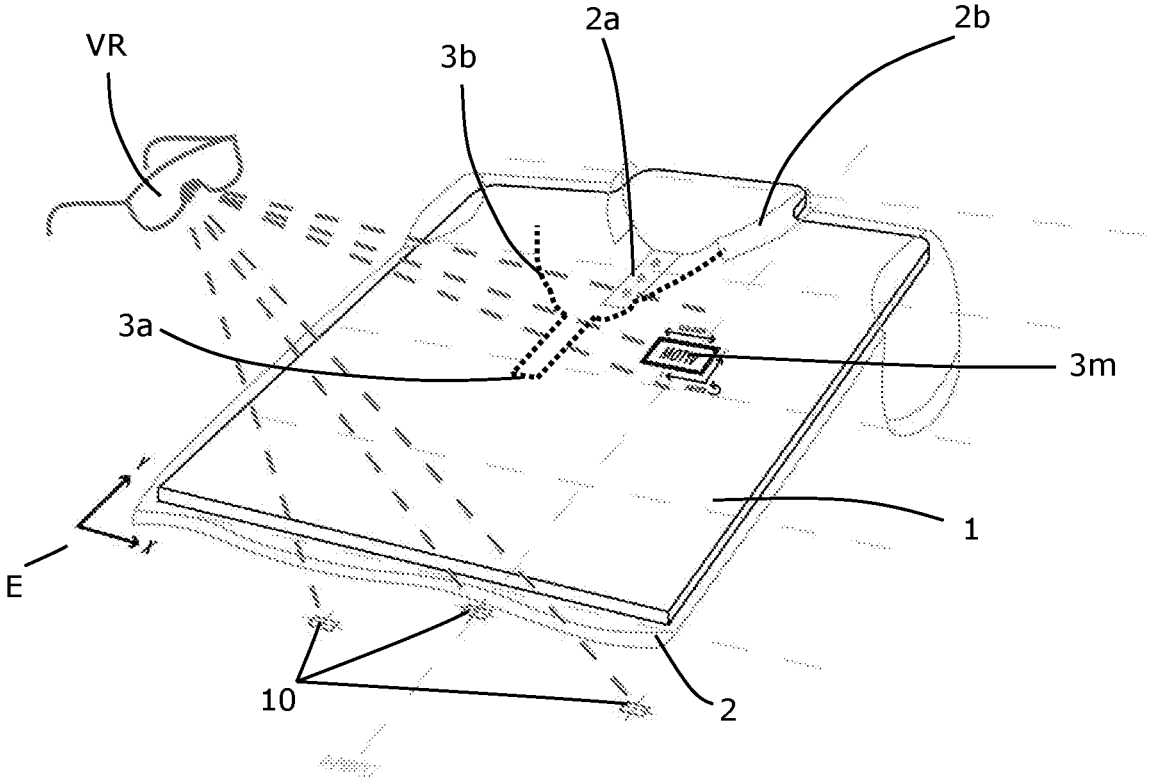
Figure 7:
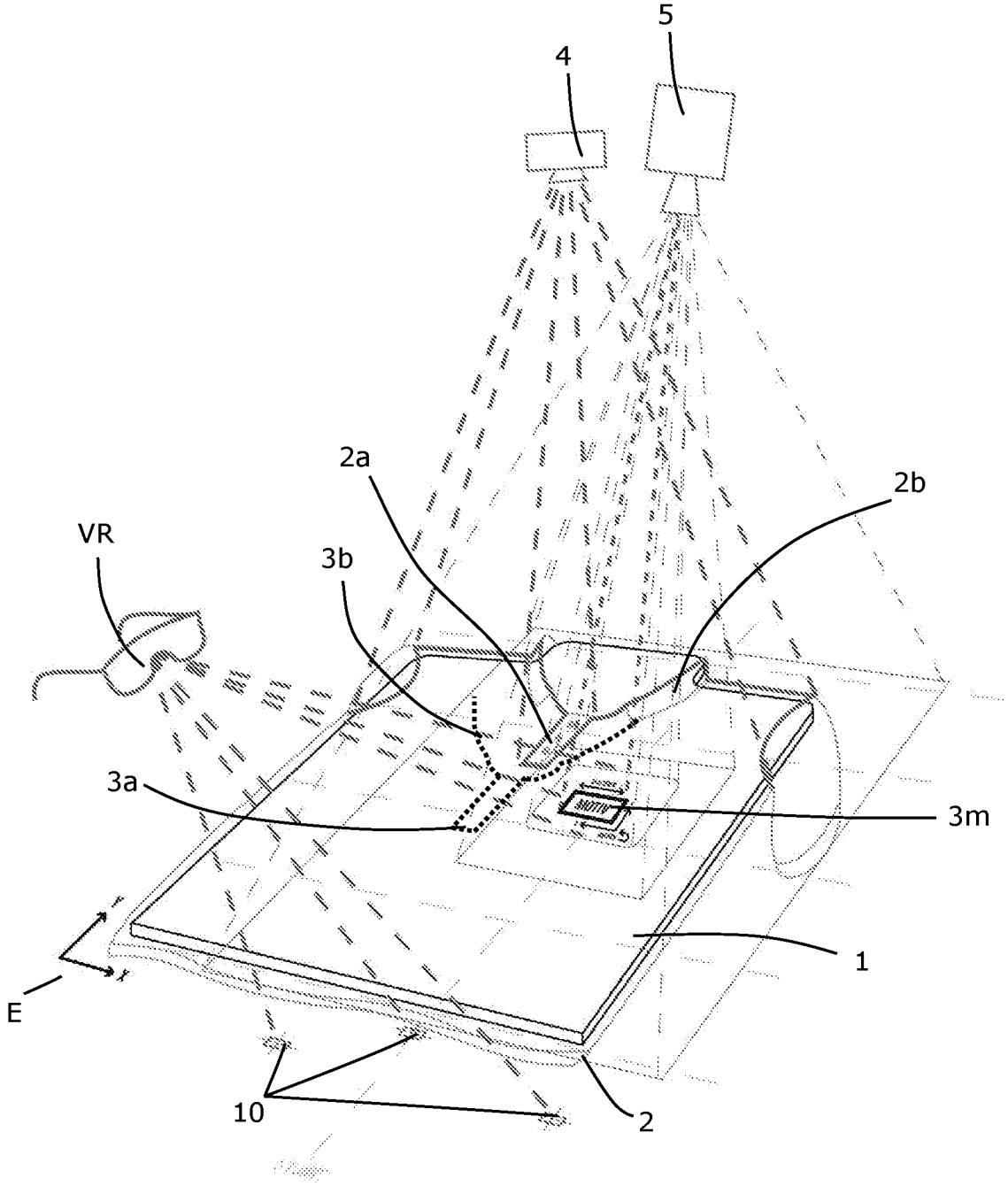

In the drawings:

FIG. 1: shows a first possible embodiment of the device according to the invention with an object holder mounted on a base, which can be shifted in a plane, over which a T-shirt to be embroidered or printed is stretched;

FIG. 2: shows a device according to FIG. 1 with a projector arranged above the object holder;

FIG. 3: shows a development of the device according to FIG. 1 with additional camera, wherein alternatively the augmented reality glasses or the projector can be used;

FIG. 4: shows a cross-sectional view through the device according to FIGS. 1 to 3;

FIG. 5: shows a second possible embodiment of the device according to the invention with an adjustable projection for the relative positioning of the holder for the motif to be imprinted or embroidered;

FIG. 6: shows a modification of the embodiment according to FIG. 5, constituting a replacement of the projector by augmented reality glasses;

FIG. 7: shows a development of the device according to FIG. 5 with additional camera, wherein the augmented reality glasses or the projector are used as an alternative.

A first possible embodiment of the device according to the invention with an object holder 6 displaceably mounted on a base B in a plane E, over which is stretched an object 2 in the form of a T-shirt to be embroidered or printed. The base B is only partially shown and is intended only to illustrate that the clamping frame holder 7 is affixed to it. The lower clamping frame part 11 is inserted into the clamping frame holder 7. As shown in FIG. 4, the T-shirt is pulled over the clamping frame holder 7 so that the clamping frame holder 7 and with it the lower clamping frame part 11 are no longer visible to the operator. The T-shirt has a collar 2*b* and a button placket 2*a*. The object holder 6 may be designed to be adjustable in width, so that different sized T-shirts 2 can be stretched over it. The lower clamping frame part 11 has a window-like opening, within which the fabric of the T-shirt 2 is stretched, so that later this area of the T-shirt can be embroidered or printed. The clamping frame part 11 stretches the fabric of the T-shirt 2 in the plane E. In the plane E, the object holder 6 is freely displaceable within certain limits, so that the object holder 6 and with it the object 2 can be positioned relative to the clamping frame holder 7 and the lower clamping frame part 11, so that the clamping frame, comprising the lower clamping frame part 11 and the upper clamping frame part 12, can be attached to a specific point of the T-shirt 2, so that the clamping frame holder 11, 12 contains and tensions the area of the T-shirt 2 on which the motif is later to be printed or embroidered.

Since the operator who operates the device does not see the lower clamping frame part 11 and can only possibly see by using a monitor, where the motif to be printed or embroidered on the T-shirt should be approximated, the operator must affix the clamping frame part to the T-shirt by eye, using imaginary lines measured with a ruler.

So that the operator can affix the clamping frames 11, 12 at the correct place on the T-shirt 2, the device according to the invention has a projection means 4, which can be for example a projector or data projector, which shows, for example, the location of the lower clamping frame part 11 on the object 2 by means of a projection 3*sr*. In addition, auxiliary lines 3*k* and/or grid lines 3*r* can be projected onto the object 2. It is easiest if certain contours of the object 2, for example the button strip 3*a* and the collar 3*b*, are projected as contours on the T-shirt 2, wherein the contours are shown projected at the distance to the motif 3*m*, which corresponds to the distance from the button placket 3*a* and collar 3*b* to the motif, which is to be later printed or embroidered. The projected contours of the button placket 3*a* and the collar 3*b* are projected at this distance to the clamping frame holder 11. In this case, the motif 3*m* to be printed or embroidered subsequently can also be projected onto the T-shirt 2. Now, the operator can move the object holder 6, with the T-shirt 2 stretched over it, in such a way that the real button placket 2*a* and the real collar 2*b* come to coincide with the projected contours of button placket 3*a* and collar 3*b*. The projected contours of button placket 3*a* and collar 3*b* do not move relative to the base B.

After the positioning of the T-shirt 2 onto the clamping frame holder 7 or the lower clamping frame part 11 has been successfully carried out, the object holder 6 can be affixed to the base, so that the mounting area of the object holder 6 is blocked. Thereafter, the upper clamping frame part 12 can be magnetically connected with the lower clamping frame part 11, for example, thereby clamping the fabric region of the T-shirt 2, which is to be printed or embroidered. After the successful fixing of the clamping frame 11, 12 on the T-shirt 2, a fine adjustment can still be carried out to the effect that the operator should shift or rotate the projected motif 3*m* relative to the T-shirt 2 within the clamping frame by means of appropriate control inputs, wherein the data processing device DV of the device notes the relative displacement and/or rotation of the motif 3*m* and later takes this displacement and/or rotation of the motif into account during the embroidery process or printing process.

FIG. 3 shows a development of the device according to FIG. 1 with additional camera 5, wherein alternatively the augmented reality glasses VR or the projector 4 can be used. For the augmented reality glasses VR, reference points 10 can be arranged on the base B and/or the clamping frame holder 7, so that an accurate positioning of the object holder 6 with the T-shirt 2 relative to the lower clamping frame part 7 is possible. The projection objects depicted in FIG. 2 are displayed in the headset when the augmented reality glasses VR are used, so that it seems to the person wearing the glasses VR as if they had been projected onto the T-shirt 2.

For the purposes of the invention, augmented reality glasses are understood to mean glasses through whose lens the user can see the surroundings, but in addition information and/or graphics can be displayed in the glasses for the user, wherein the graphics, etc. are images on real objects or the landscape.

In addition, a camera 5 may be provided by means of which e.g. the position of the T-shirt 2 can be recognised. It is also possible, after the affixing of the clamping frame 11, 12, to analyse a recording of the T-shirt 2 with clamping frame 11, 12 by means of object recognition software, in order to determine whether the clamping frame 11, 12 is affixed to the correct position on the T-shirt.

It is also possible that when using the camera 5, the positioning process is carried out automatically, in that by means of the camera 5 the current relative position of the T-shirt 2 to the lower clamping frame part 11 or base B is determined, e.g. based on its contours relative to the lower first clamping frame holder 7, and then the object holder 6 is moved by means of a drive device A so that the T-shirt 2 is in the correct position for affixing the clamping frame 11, 12. Then, either manually or automatically, the clamping frame 11, 12 can be affixed to the T-shirt 2.

FIG. 4 shows a cross-sectional view through the device according to FIGS. 1 to 3. The base B is formed by a kind of table with feet 15. A guide 16 is arranged between the base B and the object holder 6 and serves to shift the object holder 6 in the plane E, which extends perpendicular to the plane of the drawing. On the base, a kind of gallows 13 is mounted, at whose upper end the projector 4, and if necessary the camera, is mounted. On the front side 20 of the base B, the first clamping frame holder 7 is fixed, which serves to receive the lower clamping frame part 11. The object to be printed or embroidered 2 is pulled over the first clamping frame holder 7 and the object holder 6. The projector 4 projects projection objects onto the T-shirt 2 with its light beams 4*a* and thus facilitates the orientation of the T-shirt 2 relative to the lower clamping frame part 11. After alignment, the upper clamping frame section 12, which is e.g. on a second clamping frame holder 18 also affixed to the base or lower clamping frame holder 7, may be lowered onto the T-shirt 2 and connects e.g. magnetically with the lower clamping frame part 11, whereby the relevant fabric area of the T-shirt is clamped as desired. However, the upper clamping frame part 12 can also be connected purely manually with the lower clamping frame part without using a clamping frame holder 18. The optional drive device operates in conjunction with the guide 16.

FIG. 5 shows a second possible embodiment of the device according to the invention with displaceable projection 3*m*, 3*a* and 3*b* for determining the offset data for the later printing or embroidering process. In this case, the object 2 to be printed or embroidered is first of all pulled onto the holder 1 and affixed thereon, wherein it is important to ensure that the area to be embroidered or printed is actually completely located on the upper side of the holder 1. Then certain contours 3*a*, 3*b* of the object will be projected onto it, wherein the data processing device e.g. assumes that the T-shirt is optimally clamped onto the holder 1. However, since this will not actually be the case, the projected contours of the button panel 3*a* and the collar 3*b* are not in line with the button placket 2*a* and the collar 2*b* of the T-shirt 2. The operator can then shift or rotate the projection by appropriate control input and/or until the projected contours 3*a*, 3*b* are congruent with the actual button placket 2*a* and the collar 2*b*. The shift and rotation data is stored by the data processing device DV. These data are taken into account later during the printing process or embroidery process, so that the motif is printed or embroidered at the correct position of the object clamped in the holder 1.

As shown in FIG. 6, the above-described embodiment according to FIG. 5 can be modified such that the projector 4 is replaced by augmented reality glasses VR which represent the projection objects in the headset VR.

As shown in FIG. 7, the second possible embodiment described above can also be supplemented by a camera 5, which allows the same functions as already described in the device of FIG. 3.

What is claimed is:

1. A device for positioning and fixing a clamping frame onto an object to be embroidered or printed, or for positioning the object to be embroidered or printed and arranged on a holder relative to an embroidering or printing motif, the device comprising:

at least one projection means configured to project onto the object or to display in augmented reality glasses at least one projection object;

a data processing device configured to store the at least one projection object and communicatively coupled to the at least one projection means wherein the data processing device comprises a memory in which is stored or will be stored after positioning has taken place:

a type, size and/or shape of the object to be embroidered or printed, the motif to be embroidered or printed, and the position at which the motif is to be embroidered or printed on the object.

2. The device according to claim 1, wherein the at least one projection object is a point, a line, a grid, a contour of the object to be embroidered, a clamping frame window or the clamping frame contour or the motif to be embroidered or printed or its contour.

3. The device according to claim 1, wherein the projection means is configured to successively or simultaneously or optionally project a plurality of projection objects.

4. The device according to claim 1, wherein the holder is part of a printing press or printer, and is fixed during printing, or is moved only in one direction.

5. The device according to claim 1, wherein the device further comprises:

a base, to which a first clamping frame holder for receiving a first clamping frame part is fixed or is able to be fixed, wherein the device comprises the holder, which is configured for holding and/or clamping the object, wherein the holder is adjustably mounted relative to the base on the base.

6. The device according to claim 5, wherein the holder is displaceable in a plane parallel to the first clamping frame part on the base, in two directions independently.

7. The device according to claim 5, further comprising a second clamping frame holder arranged on the base, wherein the second clamping frame holder is used for receiving a second clamping frame part.

8. The device according to claim 7, wherein the second clamping frame holder is at least partially made of a flexible material or comprises a hinge configured to enable the second clamping frame part to be moved in a guided manner relative to the first clamping frame part.

9. The device according to claim 6, wherein the device further comprises a drive system configured for adjusting the holder in the plane, in the two directions independent of one another.

10. The device according to claim 1, wherein the device further comprises an image-receiving means, by means of which the device is enabled to detect outlines and/or contours of the object and/or to determine a position of the object relative to the base.

11. The device according to claim 10, wherein the at least one projection means includes augmented reality glasses, wherein the data processing device of the device is coupled with the augmented reality glasses, which use a headset of the augmented reality glasses to show an operator operating the device at which point of the object the clamping frame holder is to be attached, how the object is to be arranged or shifted relative to the base or the first and/or second clamping frame holder, or at which point exactly the motif to be printed is positioned on the object.

12. The device according to claim 7, wherein the data processing device is configured to act as a control device to position the object relative to the base and the first clamping frame holder by means of a drive system, wherein a clamping frame that includes the first and second clamping frame parts is enabled to can finally be fastened at a predetermined point on the object by joining the first and second clamping frame parts.

13. The device according to claim 12, wherein the data processing device determines, using recorded images, whether the clamping frame is attached or will be attached to a correct position of the object and generates a corresponding confirmation or error signal.

14. The device according to claim 1, wherein the at least one projection means is configured to project the motif to be embroidered or printed or its contours onto the object, and wherein projection is controlled by an operator electronically in that the projection is shifted and/or rotated relative to the object, and wherein the data processing device stores a relative displacement and/or rotation of the motif for a subsequent embroidery or printing process and accounts for the relative displacement and/or rotation of the motif in the subsequent embroidery or printing process.

15. A method of fastening a clamping frame holder using the device according to claim 7, the method comprising:

the inserting the first clamping frame part into the first clamping frame holder or affixing the first clamping frame part to the first clamping frame holder on the base, pulling the object over the holder and the first clamping frame holder, projecting a projection object, using the at least one projection means, onto the object to be embroidered or printed, adjusting the holder in a plane parallel to the first clamping frame part on the base manually or by means of a drive device, so that the object is in a correct position relative to the first and second clamping frame parts, and affixing the first and second clamping frame holders to the object, in which the first and second clamping frame parts are brought together magnetically.

16. The method according to claim 15, wherein the method further comprises:

after the adjusting the holder, wherein the adjusting is performed relative to the first and second clamping frame holders or first and second clamping frame parts, projecting the motif to be embroidered or printed or its contours onto the object; and moving and/or rotating the projection electronically relative to the object under control of an operator, wherein a control unit stores the relative displacement and/or rotation of the motif for a subsequent embroidery or printing process and accounts for the relative displacement and/or rotation of the motif during the subsequent embroidery or printing process.

17. A method of relative positioning of a motif to be embroidered or printed onto an object using the device according to claim 1, the method comprising:

mounting the object on the holder, and projecting at least the motif to be embroidered or printed or its contours onto the object by means of the at least one projection means wherein projection by the at least one projection means is controlled electronically by operator in that the motif or its contours is shifted and/or rotated relative to the object, wherein a control unit stores the relative shift and/or rotation of the motif or its contours for a subsequent embroidery or printing process and accounts for the relative shift and/or rotation of the motif or its contours during the subsequent embroidery or printing process.

* * * * *